United States Patent [19]

Hauenstein

[11] Patent Number: 4,645,433

[45] Date of Patent: Feb. 24, 1987

[54] SEALING SHROUD CENTRIFUGAL PUMP

[75] Inventor: Ernst Hauenstein, Vordemwald, Switzerland

[73] Assignee: CP Pumpen AG, Zofingen, Switzerland

[21] Appl. No.: 753,140

[22] Filed: Jul. 9, 1985

[30] Foreign Application Priority Data

Jul. 16, 1984 [CH] Switzerland ..... 03451/84

[51] Int. Cl.[4] ..... F04B 35/04; F04D 29/04

[52] U.S. Cl. ..... 417/420; 415/105; 415/106; 415/116

[58] Field of Search ..... 415/104, 105, 106, 115, 415/116, 122 R, 206; 417/353, 420

[56] References Cited

U.S. PATENT DOCUMENTS

| | | | |
|---|---|---|---|
| 2,970,548 | 2/1961 | Berner | 417/420 |
| 3,373,927 | 3/1968 | Miller | 417/420 X |
| 3,597,117 | 8/1971 | Zoehfeld | 415/206 X |
| 3,825,366 | 7/1974 | Herrick | 415/131 |
| 4,013,384 | 3/1977 | Oikawa | 417/420 X |
| 4,047,847 | 9/1977 | Oikawa | 417/420 X |
| 4,304,532 | 12/1981 | McCoy | 417/420 |

FOREIGN PATENT DOCUMENTS

| | | | |
|---|---|---|---|
| 2620502 | 11/1976 | Fed. Rep. of Germany . | |
| 555477 | 10/1974 | Switzerland . | |
| 144401 | 3/1961 | U.S.S.R. | 417/420 |

*Primary Examiner*—Robert E. Garrett
*Assistant Examiner*—Joseph M. Pitko
*Attorney, Agent, or Firm*—Werner W. Kleeman

[57] ABSTRACT

In a centrifugal pump containing a sealing shroud the pump impeller is mounted only radially for rotation on a stationary axle or shaft. The stationary axle or shaft is fixed in the suction connection by means of wing rib supports or ribs and possesses an equalizing channel which connects the pump chamber portion at the rear of the pump impeller with the suction connection. This pump chamber portion at the rear of the pump impeller is connected with the delivery or pressure connection, whereas the pump chamber portion at the front side of the pump impeller is also connected with the suction connection as well as with the delivery or pressure connection. Advantageously, throttling rings are provided for self-metering throughflow throttling, depending on the axial position of the pump impeller. Additionally, the throughflow can be regulated by a throttling screw which is provided for the equalizing channel. In this way the pump impeller requires no axial or thrust bearing and can automatically adjust itself to variable requirements within a predetermined range.

16 Claims, 2 Drawing Figures

SEALING SHROUD CENTRIFUGAL PUMP

CROSS REFERENCES TO RELATED APPLICATION

This application is related to my commonly assigned, copending U.S. patent application Ser. No. 06/753,142 filed July 9, 1985, and entitled "Sealing Shroud Centrifugal Pump", the disclosure of which is incorporated herein by reference.

BACKGROUND OF THE INVENTION

The present application broadly relates to a new and improved construction of a sealing shroud centrifugal or rotary pump, hereinafter simply referred to as a centrifugal pump.

Generally speaking, the sealing shroud centrifugal pump of the present invention comprises a pump housing and a sealing shroud which, on one side, is provided with a motor driven permanent-magnet rotor, whereas on the other side of the sealing shroud a second permanent-magnet rotor is mechanically connected with a pump impeller rotatably mounted on a stationary axle or shaft. This pump impeller, on its rear side, faces a sealing shroud bottom or base, whereas its front side faces a suction connection of the pump housing also containing a delivery or pressure connection.

Centrifugal pumps of the aforementioned type are known from German Patent Publication No. 2,620,502, published Nov. 25, 1976, in which the axle or shaft is at least partially supported at the sealing shroud bottom or base. This can result in an unwanted mechanical loading of the sealing shroud and can also cause difficulties with the equalizing of pressure differences between the front and rear of the pump impeller.

With pump impellers rotating with the shaft in a sealing shroud pump (without shroud base or bottom) it is common practice to partly equalize the pressure differences, insofar as they are not required for feeding a subsidiary or auxiliary flow for cooling and for lubrication of the rear bearing. For this purpose equalizing holes or openings were made in the pump impeller which reach from the rear of the pump impeller to the inside of the pump impeller. That these measures are associated with power losses and require that the axial bearings take up the remaining axial forces is shown by all the publications; compare, for instance, German Patent Publication No. 2,733,631, Swiss Pat. No. 529,929 and European Published Pat. No. 0,078,345.

German Published Pat. No. 2,733,631 provides for the equalizing of the fluctuating axial forces through a control of the throughput of the equalizing hole or opening of the pump impeller, which, at the least, can lead to unwanted disturbances of the pump impeller throughflow and subsequent loss of power.

In the aforementioned European Published Pat. No. 0,078,345 there is even provided a control apparatus in the pump housing to increase the area or cross-section of the equalizing openings which is controlled by the axial position of the shaft.

In the aforementioned Swiss Pat. No. 529,929 wearable axial main bearings and axial auxiliary bearings are provided, whose wear allow, under certain operating conditions, an axial positional movement of the pump impeller and which is supposed to result in a reduction of the axial forces. So far as this is even possible, in the case of changing operating conditions, and this is not seldom the case, there is always required a new wear and a new so-to-speak "working in" of the wearable axial bearings, which finally leads to total wear of the axial bearing.

Equalizing openings in the inside of the pump impeller have not been shown to be sufficiently advantageous and the control of the throughflow depending on axial position has also brought no useful improvement.

SUMMARY OF THE INVENTION

Therefore, with the foregoing in mind, it is a primary object of the present invention to provide a new and improved construction of a sealing shroud centrifugal pump which does not exhibit the aforementioned drawbacks and shortcomings of the prior art constructions.

Another and more specific object of the present invention is to provide a new and improved construction of sealing shroud centrifugal pump in which the short stationary axle or shaft, in comparison to the long corotating shafts, has the advantage that it is not necessary to take into account the lubrication of a bearing that is positioned on the far side near the drive motor.

A further important object of the present invention is to devise a simple and efficient sealing shroud centrifugal pump which also possesses a construction that leads to ease of maintenance.

A yet further object of the present invention is to provide a means of correcting large pressure differences arising during very unusual pumping conditions, and of keeping the pump impeller in a correct axial position during these conditions by means of a series of throttling rings.

Still another important object of the present invention is to provide a throttling means for the equalizing channel of the stationary shaft or axle so as to be able to adjust, from the outside, the action of the equalizing channel.

Another object of the present invention is to provide a foreign lubricant channel in the stationary shaft or axle and which lubricant channel is also connected to the outside of the centrifugal pump so that the sliding bearing of the pump impeller can be lubricated if necessary.

Now in order to implement these and still further objects of the invention, which will become more readily apparent as the description proceeds, the centrifugal pump of the present invention is manifested by the features that the stationary axle or shaft is cantilever-mounted in the suction connection and possesses an equalizing channel which leads from the suction connection to a rear portion of the pump chamber situated at the rear side of the pump impeller. The pump impeller is only radially or rotationally mounted on the stationary axle or shaft. The rear portion of the pump chamber and a front portion of the pump chamber which surrounds the suction connection are each medium connected with the suction connection and with the delivery or pressure connection.

Surprisingly it has now been found that a good controllable, practically delay-free, respectively low inertia pressure equalization is possible by means of the hollow stationary axle or shaft, without the necessity of having equalizing openings in the pump impeller.

This equalization effect is so good that an axial mounting of the pump impeller can be completely dispensed with if the space at the rear and the space at the front of the pump impeller or impeller is medium connected with the suction connection and the delivery connection, in other words, there is a medium flow connection between these spaces and the suction and pressure connections. Because of the axial position of the pump impeller, the size of the throughput or throughflow openings or areas is variable and the desired equalization is self-adjustingly or automatically achieved.

To assure that even during temporary, unfavorable, operating conditions there is no direct contact of the pump impeller with the pump housing, it is advantageous to provide throttle or throttling rings which are placed at the front and rear sides of the pump impeller and, at the front side, are preferably positioned near the stationary axle or shaft. At least at the front side a counter ring which is provided at the housing is preferred, whereas at the rear, the sealing shroud bottom or base can serve as an emergency support. These throttling rings could advantageously possess emergency running properties and can be made, for example, of polytetrafluoroethylene which is chemically stable and has good self-lubricating properties.

However, the throttling rings will hardly ever come into contact during normal operation of the centrifugal pump as they are separated from one another and respectively from the sealing shroud bottom or base by a damping medium layer, and an extreme movement of the pump impeller in any direction has the effect of instant equalization and back regulation.

BRIEF DESCRIPTION OF THE DRAWINGS

The invention will be better understood and objects other than those set forth above, will become apparent when consideration is give to the following detailed description thereof. Such description makes reference to the annexed drawings wherein, throughout the various figures of the drawings, there have been generally used the same reference characters to denote the same or analogous components and wherein.

DETAILED DESCRIPTION OF THE PREFERRED EMBODIMENTS

Figure 1:
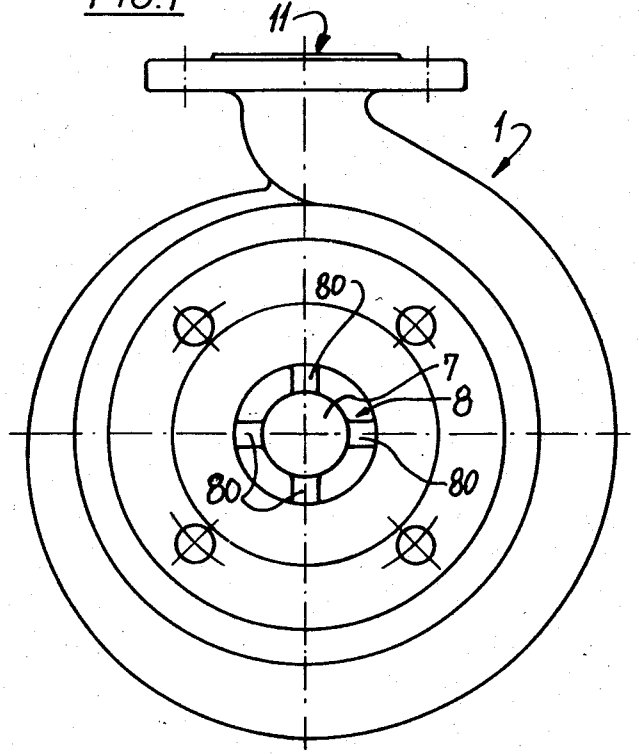
FIG. 1 schematically illustrates a front view of the inventive centrifugal pump viewed from the side of the suction connection.
Figure 2:
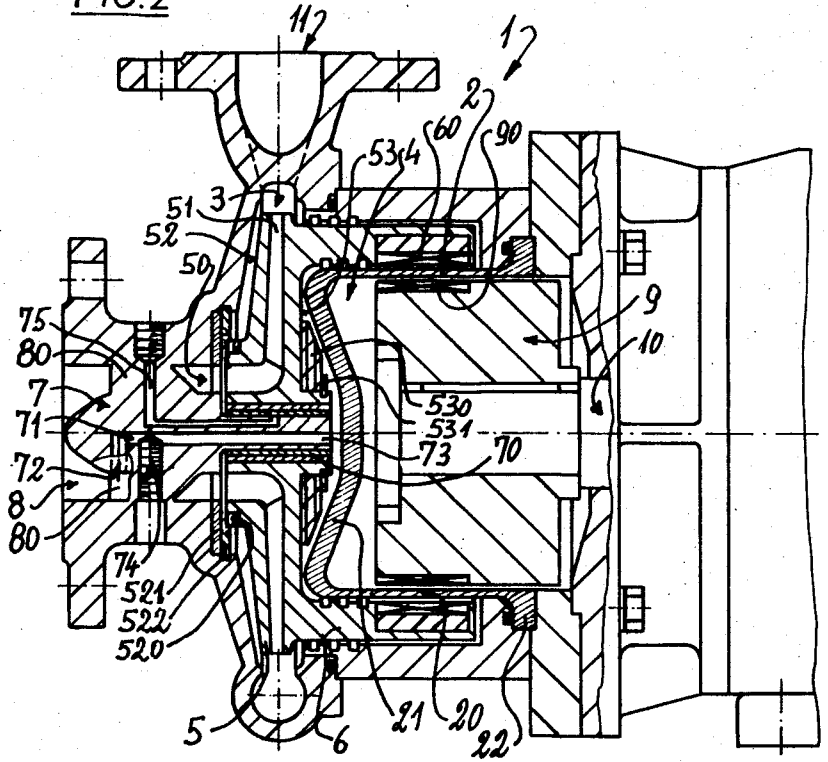
FIG. 2 is a longitudinal sectional view of the centrifugal pump depicted in FIG. 1.

Describing now the drawings, it is to be understood that to simplify the showing thereof only enough of the structure of the exemplary embodiment of the sealing shroud centrifugal pump has been illustrated therein as is needed to enable one skilled in the art to readily understand the underlying principles and concepts of this invention. Turning now specifically to FIGS. 1 and 2 of the drawings, the sealing shroud centrifugal pump depicted by way of example and not limitation therein will be seen to comprise a pump housing 1 in which there is sealingly mounted a sealing shroud or can 2 such that it sealingly separates a pump chamber 3 from a motor chamber 4 without any moving seals being necessary.

The pump chamber 3 contains a pump impeller 5 with its associated outer rotor 6 containing embedded permanent magnets 60.

The motor chamber 4 contains an electric drive motor 10 and its therewith connected inner rotor 9 containing embedded permanent magnets 90.

There is here therefore a reversal of the arrangement of the rotors containing the embedded permanent magnets in contrast to the usual or prior art construction, and a reversal of the arrangement of the sealing shroud 2, which makes it possible to load sealing shroud wall or shroud wall 20 forming the sealing shroud at least approximately only with compressive forces, which has an advantageous effect on the total construction and which is more fully described in the aforementioned commonly assigned U.S. patent application, Ser. No. 06/753,142, filed July 9,1985.

The sealing shroud wall 20 has a flange or edge 22 which is sealingly fixed in the pump housing 1 and is the only seal point of the sealing shroud 2 to the pump housing 1.

A sealing shroud bottom or base 21 of the sealing shroud 2 is connected in one piece with the shroud wall 20, wherein in this case, for example, the complete sealing shroud consists advantageously of electrically non-conductive ceramic material. For instance, such electrically non-conductive ceramic material may comprise what is commercially known as PSZ material (partially stabilized zirconium), having a density of 5.91 $Kg/dm^3$, a hardness (Knupp) of 11,700$N/mm^2$, and a bending strength of 1,020$N/mm^2$.

The sealing shroud bottom or base 21 is arched or domed towards the drive motor 10 which allows for a favorable balancing of the pump impeller 5 with the outer rotor 6.

The pump impeller 5 is radially and rotatably mounted on a stationary axle or shaft 7, whereby this mounting is restricted to a pure radial mounting. An axial mounting is not required and is not provided.

The stationary axle or shaft 7 is fixed inside a suction connection 8 by means of supporting wing ribs or ribs 80, and a ceramic sliding bearing 70 serves as the radial mounting of the pump impeller 5. A foreign lubricant channel 75 leads from the wing rib or rib 80 through the stationary axle or shaft 7 to the ceramic sliding bearing 70. With pumping media which do not adequately lubricate the sliding bearing or bearing 70, a foreign lubrication can thus be achieved.

The stationary axle or shaft 7 contains a generously dimensioned equalizing channel 71 which serves as an equalizing or compensation channel for equalizing pressure differences between both sides of the pump impeller 5 and thus reduce unwanted mechanical loading thereof. This equalizing channel 71 possesses a number of front lateral openings 72 and a rear opening 73, so that the suction connection 8 of the pump housing 1 which is located at the front side 52 of the pump impeller 5 is flow connected, through this equalizing channel 71, in a manner permitting low inertia for the pumped medium with the part of the pump chamber 3 located at the rear side 53 of the pump impeller 5.

The pump impeller 5 of the illustrated type of centrifugal or radial pump possesses a front suction opening 50 and radial channels 51 which flow communicatingly lead to a delivery or pressure connection 11 of the pump housing 1. The pump impeller 5 is otherwise free of openings. Nevertheless the part of the pump chamber 3 located at the front side 52 of the pump impeller 5 is medium flow connected with the suction connection 8 and with the delivery or pressure connection 11. Equally, the part of the pump chamber 3 located at the rear side 53 of the pump impeller 5 is medium flow connected with the delivery or pressure connection 11.

Therefore when the centrifugal pump is in operation, a pressure build-up at the rear of the pump impeller 5 can equalize itself with low inertia with a different pressure which builds-up at the front of the pump impeller 5, so that the pump impeller 5 needs no axial mounting and rotates in a self-centering manner.

Nevertheless different centrifugal pumps are used for quite specific purposes and are designed with quite specific characteristics, and also certain differences in operating conditions can arise.

In accordance with the intended purpose of use there are provided at the part of the pump chamber 3 located at the front side 52 and at the part of the pump chamber 3 located at the rear side 53 of the pump impeller 5, respective throttling rings 520 and 530 at the pump impeller 5. These throttling rings 520 and 530 make allowance for an optimal equalization of the axial self-regulating adjustment of the pump impeller 5 according to the corresponding requirements of use. The rear throttling ring 530 is held by a retainer or holding ring 531 and has no opposing or counter ring on the sealing shroud bottom or base 21, which however does not mean that, if required, no such opposing or counter ring can be fitted. In contrast thereto an opposing or counter ring 521 is fixed at the pump housing 1 near the stationary axle or shaft 7 by means of a retainer or holding ring 522.

Besides this, account can be taken of the operating conditions by means of a throttling screw 74, defining a throttling body, provided in the wing rib or rib 80, and designed as a set screw which is accessible from the outside. By means of this throttling screw 74 the free flow, i.e. the size of the flow passage in the equalizing channel 71, can be altered.

Only in very exceptional circumstances do the emergency running properties of the throttling rings 520 and 530 come into use, when, through exceptional conditions the pump impeller 5 axially moves a somewhat larger distance than is contemplated for its axial movement. Otherwise the effect of the pressure equalization through the equalizing channel 71 is so spontaneous that even large pressure fluctuations can be accommodated. The throttling rings 520 and 530 have the effect of optimally regulating, according to the corresponding requirements of use, the desired operating central position of the pump impeller 5.

Although there has been here shown by way of example a centrifugal pump, the invention can also be advantageously employed in other centrifugal pumps, as for instance in radial-axial pumps.

While there are shown and described present preferred embodiments of the invention, it is to be distinctly understood that the invention is not limited thereto, but may be otherwise variously embodied and practiced within the scope of the following claims. Accordingly,

What I claim is:

1. A centrifugal pump for pumping a medium, comprising:

a pump housing having a drive side;

said pump housing being provided with a pump chamber;

said pump housing being provided with a suction connection and a pressure connection flow communicating with said pump chamber;

a sealing shroud arranged within said pump housing and sealing the drive side of said pump housing against the action of the pumped medium;

said sealing shroud containing a sealing shroud base and a sealing shroud wall protruding from said sealing shroud base;

a motor-driven first rotor equipped with permanent magnets and arranged at one side of said sealing shroud;

a second rotor equipped with permanent magnets and arranged at an opposite side of said sealing shroud;

a stationary axle;

a pump impeller mounted for rotation upon said stationary axle;

said pump impeller being mechanically connected with said second rotor;

said pump impeller having a rear side and a front side;

said rear side of said pump impeller confronting said sealing shroud base;

said front side of said pump impeller confronting said suction connection;

said stationary axle being secured in cantilever fashion in said suction connection;

said stationary axle being provided with an equalizing channel for equalizing pressure differences between said rear side and said front side of said pump impeller and thus reducing unwanted mechanical loading and which stationary axle extends from said suction connection to a rear part of said pump chamber located behind said rear side of said pump impeller;

means for only radially mounting said pump impeller upon said stationary axle;

said pump chamber including a front part surrounding said suction connection; and said rear part of said pump chamber and said front part of said pump chamber each being in flow communication with said suction connection and said pressure connection.

2. The centrifugal pump as defined in claim 1, further including:

a throttling ring provided at least at one side of said pump impeller.

3. The centrifugal pump as defined in claim 2, wherein:

said throttling ring defines a front throttling ring;

a further throttling ring arranged at said pump housing; and said front throttling ring being situated opposite said further throttling ring.

4. The centrifugal pump as defined in claim 1, further including:

a throttling body adjustably arranged in said equalizing channel of said stationary axle.

5. The centrifugal pump as defined in claim 4, wherein:

said throttling body comprises a throttling screw.

6. The centrifugal pump as defined in claim 4, wherein:

said throttling body comprises an externally adjustable throttling body.

7. The centrifugal pump as defined in claim 1 wherein:

said means for only radially mounting said pump impeller comprises a sliding bearing; and a foreign lubricant channel extending through said stationary axle and leading to said sliding bearing of said pump impeller.

8. The centrifugal pump as defined in claim 1, further including:

throttling rings provided for said pump impeller and possessing emergency running properties.

9. The centrifugal pump as defined in claim 1 wherein:

said sealing shroud wall is at least partly surrounded by said second rotor which is equipped with said permanent magnets and which is mechanically connected to said pump impeller.

10. The centrifugal pump as defined in claim 9, wherein:

said sealing shroud base is arched away from said stationary axle and fails to come into contact with said stationary axle.

11. The centrifugal pump as defined in claim 1, wherein:

said pump impeller is devoid of equalizing openings.

12. The centrifugal pump as defined in claim 1, further including:

at least one throttling ring arranged near to said stationary axle.

13. The centrifugal pump as defined in claim 1, wherein:

said means for only radially mounting said pump impeller upon said stationary axle permits an axial displacement of said pump impeller relative to said stationary axle.

14. The centrifugal pump as defined in claim 1, wherein:

said sealing shroud wall has an inner surface and an outer surface;

said motor-driven first rotor equipped with permanent magnets being arranged at said inner surface of said sealing shroud wall; and said second rotor equipped with permanent magnets being arranged at said outer surface of said sealing shroud wall.

15. The centrifugal pump as defined in claim 1, wherein:

said sealing shroud wall extends substantially coaxial to said stationary axle.

16. A centrifugal pump for pumping a medium, comprising:

a pump housing having a drive side;

said pump housing being provided with a pump chamber;

said pump housing being provided with a suction connection and a pressure connection flow communicating with said pump chamber;

a sealing shroud arranged within said pump housing and sealing the drive side of said pump housing against the action of the pumped medium;

said sealing shroud containing a sealing shroud base and a sealing shroud wall protruding from said sealing shroud base;

a motor-driven first rotor equipped with permanent magnets and arranged at one side of said sealing shroud;

a second rotor equipped with permanent magnets and arranged at an opposite side of said sealing shroud;

a stationary axle;

a pump impeller mounted for rotation upon said stationary axle;

said pump impeller being mechanically connected with said second rotor;

said pump impeller having a rear side and a front side;

said rear side of said pump impeller confronting said sealing shroud base;

said front side of said pump impeller confronting said suction connection;

said stationary axle being secured in cantilever fashion in said suction connection;

said stationary axle being provided with an equalizing channel for equalizing pressure differences between said rear side and said front side of said pump impeller and thus reducing unwanted mechanical loading and which stationary axle extends from said suction connection to a rear part of said pump chamber located behind said rear side of said pump impeller;

means for only radially mounting said pump impeller upon said stationary axle;

said pump chamber including a front part surrounding said suction connection;

said rear part of said pump chamber and said front part of said pump chamber each being in flow communication with said suction connection and said pressure connection;

said sealing shroud wall being at least partly surrounded by said second rotor which is equipped with said permanent magnets and which is mechanically connected to said pump impeller; and said means for only radially mounting said pump impeller upon said stationary axle permitting an axial displacement of said pump impeller relative to said stationary axle.

* * * * *